United States Patent [19]

Miller

[11] Patent Number: 4,617,917

[45] Date of Patent: Oct. 21, 1986

[54] FOOT HYGIENE DEVICE

[75] Inventor: Griffith C. Miller, Norman, Okla.

[73] Assignee: Dr. Miller's Health Care Products, Inc., Norman, Okla.

[21] Appl. No.: 569,495

[22] Filed: Jan. 9, 1984

[51] Int. Cl.[4] ..... A46B 5/00; A61H 7/00

[52] U.S. Cl. ..... 128/62 R; 15/161; 15/159 A

[58] Field of Search ..... 132/85, 120; 128/62 R; 15/159 A, 161, 190, 191 R, 193

[56] References Cited

U.S. PATENT DOCUMENTS

| | | | |
|---|---|---|---|
| Re. 27,455 | 8/1972 | Lewis | 300/2 |
| 718,861 | 1/1903 | McEachern | 15/161 |
| 747,031 | 12/1903 | Bartoszek | 15/161 |
| 1,569,939 | 1/1926 | Sperling | 15/161 |
| 2,210,365 | 8/1940 | Gilpin | 15/161 |
| 2,591,331 | 4/1952 | Baumbach | 15/161 X |
| 2,664,316 | 12/1953 | Winslow, Jr. et al. | 15/191 R X |
| 2,852,793 | 9/1958 | Shelton | 15/106 |
| 3,359,572 | 12/1967 | Blackwell | 4/1 |
| 3,416,178 | 12/1968 | James . | |
| 3,471,202 | 10/1969 | Lewis | 300/2 |
| 3,548,439 | 12/1970 | Berst . | |
| 3,596,999 | 8/1971 | Lewis | 300/21 |
| 3,604,043 | 9/1971 | Lewis, Jr. | 15/159 A |
| 3,973,286 | 8/1976 | Logan | 15/21 D |
| 4,003,372 | 1/1977 | Willoby | 125/25 B |

*Primary Examiner*—Robert P. Swiatek
*Attorney, Agent, or Firm*—Glen M. Burdick

[57] ABSTRACT

A foot hygiene device is provided which comprises a foundation member, a ventral brush supported by the foundation member for applying a scrubbing force to a ventral surface of the foot upon movement of the foot thereagainst; a lateral brush assembly supported by the foundation member for applying a scrubbing force to at least one lateral surface of the foot upon movement of the foot thereagainst, the lateral brush assembly extending upwardly from the foundation member so as to be substantially normally disposed to the foundation member; and a dorsal brush for applying a scrubbing force to a dorsal surface of the foot on movement of the foot thereagainst, the dorsal brush supported by a distal end portion of the lateral brush assembly a selected distance from the vertical brush so as to form a substantially unrestricted passageway therebetween. A plurality of digital brushes are supported by the dorsal brush and extend a selected distance into the passageway formed between the dorsal brush and the ventral brush such that upon movement of the foot in the to and fro direction the digital brushes can be selectively positioned between digits on the foot to clean therebetween.

10 Claims, 7 Drawing Figures

FOOT HYGIENE DEVICE

BACKGROUND OF THE INVENTION

1. Field of the Invention

The present invention relates to cleaning devices useful in personal hygiene, and more particularly but not by way of limitation, to an improved foot hygiene device for massaging and cleansing the feet.

2. Description of Prior Art

Brushes, such as hand brushes, foot brushes, and brushes of general utility have long been recommended for use in personal hygiene. Perhaps the most neglected area of a person's body is their feet. Most people rarely clean their feet properly which results in numerous diseases to the feet, discomfort of the feet and the like.

Numerous foot cleaning apparatus, including brushes, have heretofore been proposed. However, such prior art devices have generally met with limited success because such devices are cumbersome, generally unsightly, complex in structure, and difficult to use. Because of these characteristics people have resisted the use of foot cleansing or brush devices.

As previously stated, the feet are perhaps the most neglected portion of the body in the area of personal hygiene. Thus, it would be highly desirable if one could develop a foot hygiene device which could overcome the deficiencies of the prior art devices, be economical to manufacture, and be versatile such that substantially all parts of the foot could be easily and thoroughly cleaned.

SUMMARY OF THE INVENTION

The present invention provides an improved foot hygiene device for massaging and cleaning the feet. Broadly, the foot hygiene device of the present invention comprises a foundation member having an upper planar surface and a substantially parallel, spatially disposed lower planar surface, and a brush assembly supported thereon so that the foot can be substantially moved in a to and fro direction in the brush assembly without any substantial restriction or abutments being created on the digits of the foot due to the movement of the foot in the brush assembly.

The brush assembly of the foot hygiene device comprises a ventral brush supported by the upper planer surface of the foundation member for applying a scrubbing force to a ventral surface of the foot upon movement of the foot thereagainst; a lateral brush assembly supported by the upper planar surface of the foundation member for applying a scrubbing force to at least one lateral surface of the foot upon movement of the foot thereagainst, the lateral brush assembly extending upwardly from the foundation member so as to be substantially normally disposed to the upper planar surface of the foundation member; and a dorsal brush for applying a scrubbing force to a dorsal surface of the foot on movement of the foot thereagainst, the dorsal brush supported by a distal end portion of the lateral brush assembly a selected distance from the vertical brush so as to form a substantially unrestricted passageway therebetween. A plurality of digital brushes are supported by the dorsal brush and extend a selected distance into the passageway formed between the dorsal brush and the ventral brush such that upon movement of the foot in the to and fro direction the digital brushes can be selectively positioned between digits on the foot to clean therebetween.

An object of the present invention is to provide an improved foot hygiene device which can effectively clean all surfaces of a foot by a scrubbing force created by movement of the foot upon selected elements of the device.

Another object of the present invention, while achieving the above stated object, is to provide a foot cleansing device by which the cleansing operation is performed with little effort and which is not limited in structure to the size of the foot being cleaned.

Yet another object of the present invention, while achieving the above stated objects, is to provide a foot hygiene device for washing and massaging a person's foot which is simple in structure, inexpensive to manufacture, easily used, and durable.

DESCRIPTION OF THE PREFERRED EMBODIMENTS

Figure 1:
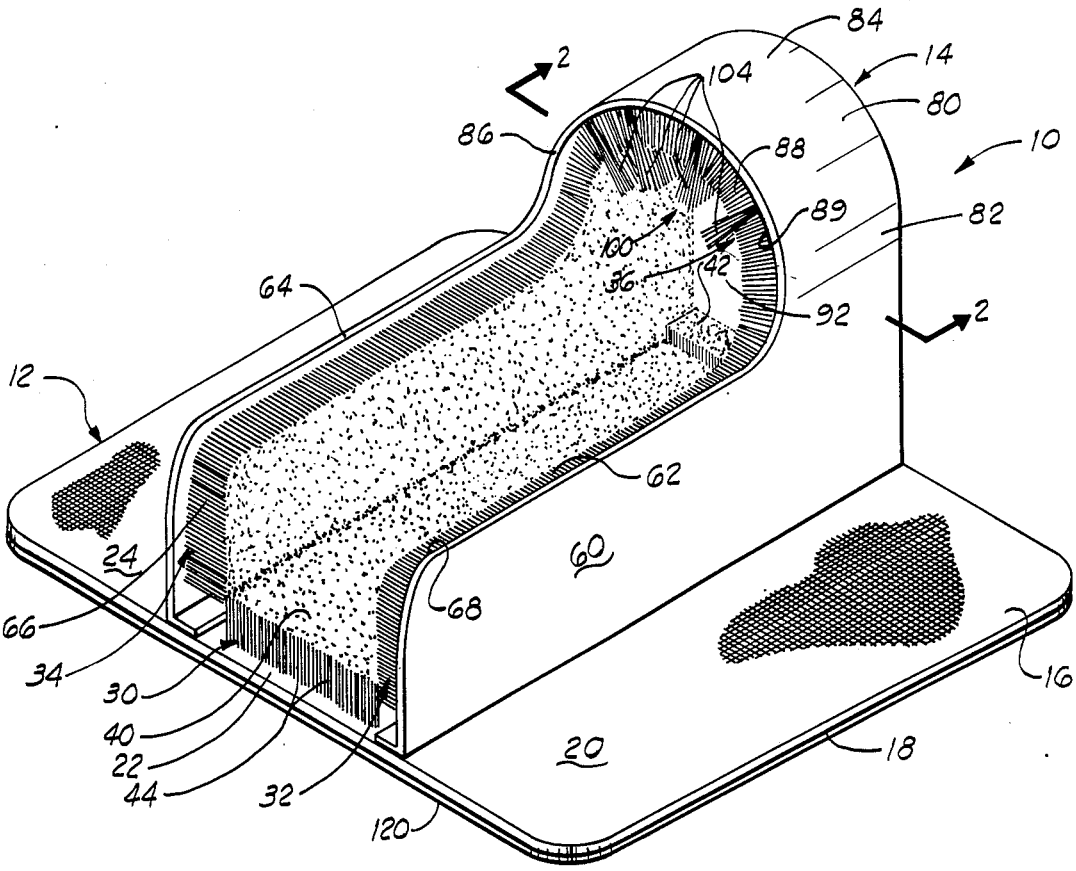
FIG. 1 is an isometric view of a foot hygiene device constructed in accordance with the present invention.
Figure 2:
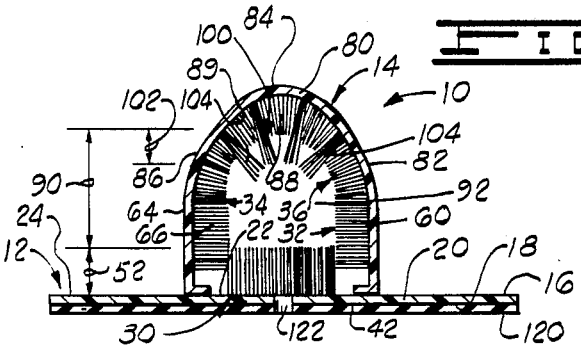
FIG. 2 is a cross-sectional view of the foot hygiene device of FIG. 1 taken along line 2—2.
Figure 3:
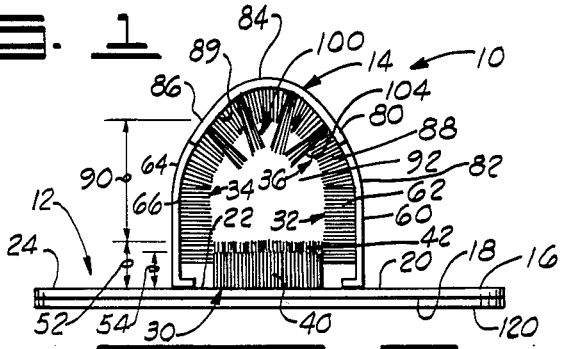
FIG. 3 is an end plan view of the foot hygiene device of the present invention viewed from the foot receiving end of such device.

Referring to the drawings, and particularly to FIGS. 1, 2, 3 and 4, shown therein is a foot hygiene device 10 embodying the principles of the present invention. The device 10 comprises a foundation member or base plate 12 and a brush assembly 14. The foundation member 12, a substantially flat member having an upper planar surface 16 and a substantially parallel, spatially disposed lower planar surface 18, is characterized as having a first portion 20, a medial portion 22, and a second portion 24. The foundation member 12 is preferably fabricated of a pliable, resiliant polymeric substance, such as from a sheet of polypropylene, so that the foundation member 12 will substantially conform to a supporting surface for the foot hygiene device 10 when same is use, such as a bath tub, the floor of a shower and the like.

The brush assembly 14 is supported on the upper planar surface 16 of the foundation member 12 in the medial portion 22 so that the first and second portions 20, 24 of the foundation member 12 extend outwardly from thr brush assembly 14 substantially as shown. The dimensions of the foundation member 12 and the brush assembly 14 can vary widely, but generally the device 10 will be designed so that the brush assembly 14 can be used on substantially all sizes of feet, including children's feet, ladies' feet and the feet of large men. Further, the foundation member 12 should be of sufficient size to enable one foot of the user of the device 10 to be selectively placed on one of the first or second portions 20, 24 during contact of the other foot with the brush assembly 14. The upper surfaces 16 of each of the first and second portions 20, 24 are preferably provided with a non-skid surface which will help stabilize the foot of the user and prevent the foot positioned thereon from slipping during the cleaning of the outer foot. Any suitable non-skid surface can be used, such as a diamond cut saurface (illustrated in FIG. 1) formed in the upper surface 16 of the first and second portions 20, 24 during the formation of the device 10.

The brush assembly 14 of the foot hygiene device 10 comprises a ventral brush 30 for applying a scrubbing force to ventral surface of a foot upon movement of the foot thereagainst, a pair of spatially disposed lateral brushes 32, 34 for applying a scrubbing force to at least one lateral surface of the foot upon movement of the foot thereagainst, and a dorsal brush 36 for applying a scrubbing force to a dorsal surface of the foot upon movement of the foot thereagainst. The ventral brush 30, a substantially rectangularly shaped tufted brush member having a first end portion 40 and an opposed second end portion 42, is disposed along the upper planar surface 16 of the medial portion 22 of the foundation member 12 such that the ventral brush 30 extends substantially the length of the medial portion 22 of the foundation member 12. The ventral brush 30 is formed of a plurality of spatially disposed tufts extending upwardly from the foundation member 12 substantially as shown.

Figure 5:
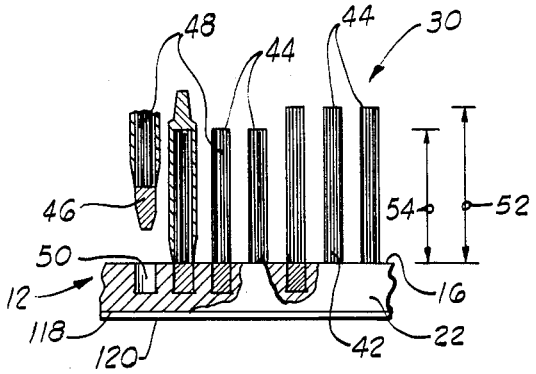
FIG. 5 is an enlarged, partial cross-sectioned, fragmentary view of a portion of the distal end portion of the ventral brush of the foot hygiene device of FIG. 1.

Referring more particularly to FIGS. 1 and 5, the ventral brush 30 comprises a plurality of mutually spaced filament tufts 44 which extend integrally from the medial portion 22 of the foundation member 12. Each of the filament tufts 44 is formed of a plurality of synthetic filaments. The filament tufts 44 of the ventral brush 30 can be secured to the medial portion 22 of the foundation member 12 by an suitable means. One especially desirable method is achieved by prefusing one end portion 46 of a group of parallel fibers 48 at a temperature of approximately that of the melting point of the particular type of synthetic fiber employed to form the filament tufts 44.

In order to seal the filament tufts 44 of the ventral brush 30 to the foundation member 12 a plurality of mutually spaced apertures, such as aperture 50, are formed in the medial portion 22 of the foundation member 12 via the upper planar surface 16. Each of the apertures 50 is adapted to receive the fused end portion 46 of one of the heat sealed filament tufts 44. Thus, upon positioning the heat fused end portion 46 of the filament tuft 44 into the aperture 50 the fused end portion 46 (which is still in the pliable or softened state) conforms to the geometric confines of the aperture 50 to hold and seal the filament tuft 44 to the medial portion 22 of the foundation member 12 substantially as shown in FIG. 5.

The diameter of the fibers used to form the filament tufts 44 of the ventral brush 30 can vary widely but will generally be within from about 0.008 to about 0.025 inches; and the selection of the particular fiber will generally depend upon the degree of firmness desired to be imparted to the filament tufts 44 of the ventral brush 30. Likewise, the length of the cut-to-length fibers 48 can vary widely but desirable results have been obtained wherein the length of such fibers is from about $\frac{3}{4}$ to about $1\frac{1}{2}$ inches. The composition of the synthetic fibers 48 picked and assembled into the filament tufts 44 of the ventral brush 30 is not limited other than the degree of firmness or softness desired to be imparted to the ventral brush 30. Thus, polymers such as polyamide, polypropylene, polyethylene, co-polymers of polypropylene and ethylene, polyfluoride and the like can be used in the formation of the filament tufts 44 of the ventral brush 30 of the hygiene device 10.

Figure 4:
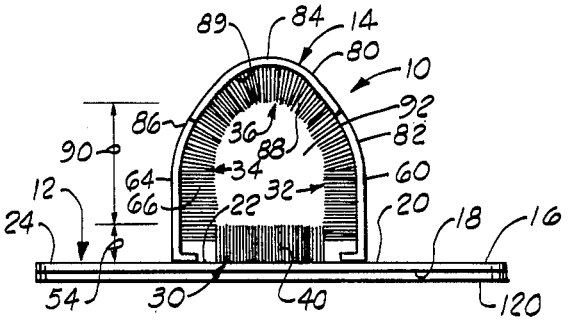
FIG. 4 is an end plan view of an embodiment of a foot hygiene device constructed in accordance with the present invention and having digital brushes removed therefrom, such device being illustrated from the end portion forming a foot receiving passageway in the brush assembly.

While the filament tufts 44 forming the ventral brush 30 of the foot hygiene device 10 of the present invention can be of sufficiently the same length throughout (as illustrated in FIG. 4), desirable results have been obtained when the filament tufts 44 forming the second end portion 42 of the ventral brush 30 are provided with a length 52 greater than a length 54 of the remaining filament tufts 44 forming the ventral brush 30 (substantially as shown in FIGS. 1, 2, 3 and 5). By providing the filament tufts 44 forming the second end portion 42 of the ventral brush 30 with the length 52 (which is desirably about $\frac{1}{4}$ inch greater than the length 54 of the remaining tufts 44 of the ventral brush 30), the digital members of a foot can readily be forced over the filament tufts 44 forming the second end portion 42 of the ventral brush 30 without any substantial restriction on the digital members of the foot. Further, the longer length of the filament tufts 44 forming the second end portion 42 of the ventral brush 30 creates a scrubbing force in the area where the digits are joined to the foot.

Referring again to FIGS. 1, 2, and 3 and 4, the lateral brush 32 comprises an upright member 60 supported by the foundation member 12 so as to be substantially adjacent one side of the ventral brush 30. A plurality of mutually spaced side filament tufts 62 extend integrally from the upright member 60 such that the side filament tufts 62 extend in the direction of the lateral brush 34 and are substantially normally disposed to the elongated axis of the filament tufts 44 of the ventral brush 30. Similarly, the second lateral brush 34 comprises an upright member 64 supported by the foundation member 12 substantially adjacent a second side of the ventral brush 30 so as to be substantially parallel and in a spatial relationship with the upright member 60 of the first lateral brush 32. A plurality of mutually spaced side filament tufts 66 extend integrally from the upright member 64 of the second lateral brush 34 so as to be substantially normally disposed to the elongated axis of the filament tufts 44 of the ventral brush 30 and in a facing relationship with the side filament tufts 62 of the first lateral brush 32. The distance between the upright member 60 of the first lateral brush 32 and the upright member 64 of the second lateral brush 34 can vary widely, and will be dependent upon the desired width of the ventral brush 30. However, it has been found that a substantially universal foot hygiene device can be constructed which will be useful for the feet of most people, regardless of size, when the width of the ventral brush 30 is about $3\frac{1}{4}$ inches, the upright members 60, 64 of the first and second lateral brushes 32, 34, respectively, are spaces about 5 inches apart, the upright members 60, 62 of the lateral brushes 32, 34 are provided with a heighth of approximately $3\frac{1}{2}$ inches, and the length of the ventral brush and the first and second lateral brushes 32, 34 is approximately $8\frac{3}{4}$ inches.

Figure 6:
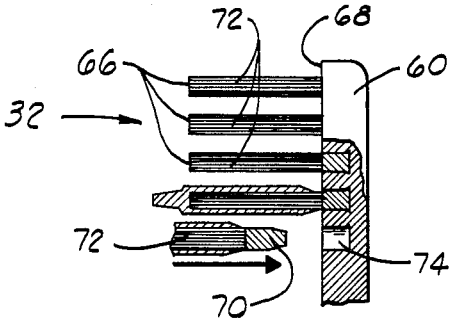
FIG. 6 is an enlarged, partial cross-sectional, fragmentary view of a portion of the lateral brush of the foot hygiene device of FIG. 1.

The first and second lateral brushes 32, 34, and thus each element forming such lateral brushes, are substantially identical in configuration and mere mirror images of one another. Thus, only the interconnection of the side filament tufts 62 to the upright member 60 of the first lateral brush 32 will be described in detail with reference to FIGS. 1 and 6.

The plurality of mutually spaced side filament tufts 62 extend integrally from an inner disposed surface 68 of the first upright member 60 such that the longitudinal axis of each of the side filament tufts 62 is substantially normally disposed to the elongated axes of the filament tufts 44 of the ventral brush 30. Each of the side filament tufts 62 is formed of a plurality of synthetic filaments. The side filament tufts 62 of the first upright member 60 of the lateral brush 32 can be secured to the inner disposed surface 68 of the first upright member 60 by any suitable means. One especially desirable method is achieved by prefusing one end portion 70 of a group of parallel fibers 72 at a temperature of approximately that of the melting point of the particular type of synthetic fiber employed to form the side filament tufts 62.

In order to seal the side filament tufts 62 of the lateral brush 32 to the upright member 60 a plurality of mutually spaced apertures, such as aperture 74, are formed in the upright member 60 of the lateral brush 32 via the inner surface 68. Each of the apertures 74 is adapted to receive the fused end portion 70 of one of the heat sealed side filament tufts 62 such that upon positioning the heat fused end portion 70 of the side filament tuft 62 into the aperture 74 the fused end portion 70 (which is still in the pliable or softened state) conforms to the geometric confines of the aperture 74 to hold and seal the side filament tuft 62 to the upright member 60 of the lateral brush 34.

The diameter of the fibers used to form the side filament tufts 62, 66 of the lateral brushes 32 and 34 can vary widely but will generally be within from about 0.008 to about 0.025 inches; and the selection of the particular fiber will generally depend upon the degree of stiffness desired to be imparted to the side filament tufts 62, 66 of the lateral brushes 32, 34. Likewise, the length of the cut-to-length fibers 72 can vary widely but desirable results have been obtained wherein the length of such fibers is from about $\frac{3}{4}$ to about $1\frac{1}{2}$ inches. The composition of the synthetic fibers 72 picked and assembled into the side filament tufts of the lateral brushes, such as the side filament tufts 62 of the lateral brush 32, is not limited other than by the degree of firmness or softness desired in the lateral brushes 32, 34. Thus, polymers such as polyamide, polypropylene, polyethylene, co-polymers of polypropylene and ethylene, polyfluoride and the like can be employed in the formation of the side filament tufts 62, 66 employed to form the lateral brushes 32, 34 of the hygiene device 10.

Referring again to FIGS. 1, 2, 3 and 4, the dorsal brush 36 of the foot hygiene device 10 comprises a bridge member 80 having a first end 82, a medial portion 84 and a second end 86. The first end 82 of the bridge member 80 is supported by the upright member 60 of the first lateral brush 32; and the second end 86 of the bridge member 80 is supported by the upright member 64 of the second lateral brush 34 such that the medial portion 84 of the bridge member 80 forms an arch over the second end portion 42 of the ventral brush 30 substantially as shown. A plurality of mutually spaced bridge filament tufts 88 extend integrally from a lower surface 89 of the medial portion 84 of the bridge member 80 in the direction of the ventral brush 30. The bridge filament tufts 88 terminate a selected distance 90 above the filament tufts 44 of the ventral brush 30 so a substantially unrestricted passageway 92 is formed therebetween. Thus, when positioning the foot on the ventral brush 30 the foot can be moved in a to and fro direction without "stubbing" the digits on the foot as a result of obstacles blocking the end of the passageway 92.

The unique construction and interconnection of the ventral brush 30, the first and second lateral brushes 32, 34, and the dorsal brush 36 enable one to readily clean the ventral surface, lateral surface and dorsal surface of a foot using the foot hygiene device 10. However, it is also desirable to clean between the digits of the foot for proper hygiene. Thus, the foot hygiene device 10 illustrated in FIGS. 1, 2 and 3 further comprises a plurality of digital brushes 100 supported via the lower surface 89 of the medial portion 84 of the bridge member 80 such that the digital brushes 100 extend a selected distance 102 into the passageway 92 formed between the bridge filament tufts 88 of the dorsal brush 36 and the filament tufts 44 of the ventral brush 30.

The digital brushes 100 preferably comprise four rows of digital filament tufts 104 extending integrally from the lower surface 89 of the medial portion 84 of the bridge member 80. The rows of digital filament tufts 104 are in a spatial relationship such that each of the rows of digital filament tufts 104 can be forceably moved between adjacent digits on the foot by raising the digits into contact with the digital brushes 100. Thereafter, by employing a to and fro movement of the foot the digital brushes 100 provide a scrubbing or cleaning action to the area of the foot disposed between adjacent digits.

Figure 7:
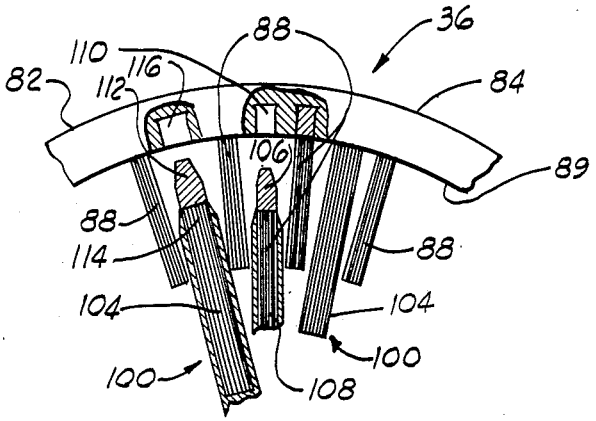
FIG. 7 is an enlarged, partial cross-sectional, fragmentary view illustrating the dorsal brush of the foot hygiene device of FIG. 1 illustrating the relationship between a plurality of digital brushes and the dorsal brush.

Referring more specifically to FIGS. 1 and 7, the interconnection of the bridge filament tufts 88 and the digital tufts 104 to the bridge member 80 of the dorsal brush 36 will be more fully described. The plurality of mutually spaced bridge filament tufts 88 of the dorsal brush 36 extend integrally from the lower surface 89 of the medial portion 84 of the bridge member 80 substantially as shown. Each of the bridge filament tufts 88 is formed of a plurality of synthetic filaments. The bridge filament tufts 88 of the bridge member 80 of the dorsal brush 36 can be secured to the lower surface 89 of the medial portion 84 of the bridge member 80 by any suitable means. One especially desirable method is achieved by prefusing one end portion 106 of a group of parallel fibers 108 at a temperature of approximately that of the melting point of the particular type of synthetic fiber employed to form the bridge filament tufts 88.

In order to seal the bridge filament tufts 88 of the dorsal brush 36 to the bridge member 80 a plurality of mutually spacer apertures, such as aperture 110, are formed in the bridge member 80 of the dorsal brush 36 via the lower surface 89. Each of the apertures 110 is adapted to receive the fused end portion 106 of one of the heat sealed bridge filament tufts 88. Thus, upon positioning the heat fused end portion 106 of the bridge filament tufts 88 into the aperture 110, the fused end portion 106 (which is still in the pliable or softened state) conforms to the geometric confines of the aperture 110 to hold and seal the bridge filament tuft 88 to the bridge member 80 of the dorsal brush 36 substantially as shown in FIG. 7.

Similarly, the four rows of digital filament tufts 104 of the digital brush 100 extend integrally from the lower surface 89 of the medial portion 84 of the bridge member 80 so as to be in a spatial relationship with each adjacent row of digital filament tufts 104 substantially as shown. Each of the digital filament tufts 104, which are formed of a plurality of synthetic filaments, can be secured to the lower surface 89 of the medial portion 84 of the bridge member 80 by any suitable means. One especially desirable method is achieved by prefusing one end portion 112 of a group of parallel fibers 114 at a temperature of approximately that of the melting point of the particular type of synthetic fiber employed to form the digital filament tufts 104.

In order to seal the digital filament tufts 104 of the digital brush 100 to the bridge member 80 a plurality of mutually spacer apertures, such as aperture 116, are formed in the bridge member 80 of the dorsal brush 36 via the lower surface 89. Each of the apertures 116 is adapted to receive the fused end portion 112 of one of the heat sealed digital filament tufts 104. Thus, upon positioning the heat fused end portion 112 of the digital filament tufts 104 into the aperture 116 the fused end portion 112 (which is still in the pliable or softened state) conforms to the geometric confines of the aperture 116 to hold and seal the digital filament tuft 104 to the bridge member 80 of the dorsal brush 36.

The diameter of the fibers used to form the bridge filament tufts 88 of the dorsal brush 36 and the digital filament tufts 104 of the digital brush 100 can vary widely, but will generally be within about 0.008 to about 0.025 inches, the selection of the particular fiber depending upon the degree of stiffness desired to be imparted to the bridge filament tufts 88 dorsal brush 36 and the digital filament tufts 104 of the digital brush 100. Likewise, the length of the cut-to-length fibers 108, 114 of the bridge filament tufts 88 and the digital filament tufts 104, respectively, can vary widely. However, desirable results have been obtained wherein the length of the fibers 108 of the bridge filament tufts 88 is from about $\frac{3}{4}$ to about $1\frac{1}{2}$ inches, the length of the fibers 114 of the digital filament tufts 104 is from about $1\frac{1}{4}$ to $2\frac{1}{4}$ inches, and the digital filament tufts 104 have a length of from about $\frac{1}{2}$ to $\frac{3}{4}$ inches greater than the length of the bridge filament tufts 88.

The composition of the synthetic fibers 108 picked and assembled into the bridge filament tufts 88 of the dorsal brush 36, and the synthetic fibers 114 picked and assembled into the digital filament tufts 104 of the digital brush 100, is not limited other than by the degree of firmness or softness desired in the dorsal brush 36 and the digital brush 100. Thus, polymers such as polyamide, polypropylene, polyethylene, co-polymers of polypropylene and ethylene, polyflouride and the like can be employed in the formation of the bridge filament tufts 88 of the dorsal brush 36 and the digital filament tufts 104 of the digital brush 100 of the hygiene device 10.

The brush assembly 14 of the foot hygiene device 10 can be fabricated using any suitable method and apparatus. However, because of the desire to fabricate the brush assembly for durability, especially desirable results have been obtained when the brush assembly 14 (i.e. the ventral brush 30, the lateral brushes 32, 34, the dorsal brush 36 and the digital brush 100) are fabricated using the apparatus disclosed in U.S. Pat. No. Re. 27,445 entitled "Brush Machinery and Brush Construction" and assigned to Tucel Industries, Inc. of Middleburg, Vt. Further, when constructing the brush assembly 14 of the present invention using the apparatus disclosed in said before-mentioned U.S. Pat. No. Re. 27,445, the various elements of the brush assembly are fabricated from a common material so that the various filament tufts can be heat sealably joined to their respective support members.

As previously stated, the foundation member 12 of the foot hygiene device 10 is fabricated of a pliable, resilient polymer substance so that when the device 10 is placed on a supporting surface, such as in a bath tub or on the floor of a shower, the foundation member 12 will substantially conform to the contour of the supporting surface, especially when pressure is applied thereto by placement of a person's foot on one of the first or second side portions 20, 24 of the foundation member 12. Because substances fabricated from polymeric materaials often have a tendency to be unstable when placed on a water wet surface, it is desirable that the lower surface 18 of the foundation member 12 be modified to render such surface with non-slip characteristics. Any suitable means can be employed to provide the lower surface 18 with the desired non-slip characteristics. For example, a rubberized mat member 120 can be secure to the lower surface 18 of the foundation member 12 with a commercially available water repellant adhesive. The rubberized mat so attached stabilizes the foot hygiene device, even when placed on a water wet surface, so that the device 10 does not slip or skid when used to clean a person's feet.

To prevent mildew and odors from forming and accumulating on the foot hygiene device 10, it is desirable to position the foot hygiene device 10 in a position so that substantially all water can readily be drained when the device 10 is not in use. To assist the user in the storage of the device 10, as well as to insure proper drainage of the device 10, an aperture 122 (see FIG. 2) is formed in the medial portion 22 of the foundation member 12 and the rubberized mat member 120 at a position in close proximity to the second end portion 42 of the ventral brush 30. The aperture 122 is adapted to receive a hook element (not shown) mounted in the shower stall or over the bath tub such that upon inserting the hook element through the aperture 122 the device 10 is stored in a position in which the foot receiving passageway 92 is substantially vertically disposed and thereby insuring drainage of any water remaining on the device 10.

The foot hygiene device 10 described above is desirably fabricated as a unitary unit. However, it is to be understood that a device can be fabricated using multiple interconnected components without departing from the spirit of the invention and the benefits obtained by the use of the foot hygiene device 10. Thus, the foot hygiene device 10 of the present invention is well adapted to carry out the objects and attain the ends and advantages mentioned as well as those inherent therein. It will be understood that numerous changes may be made which will readily suggest themselves to those skilled in the art and which are encompassed within the spirit of the invention and as defined in the appended claims.

What is claimed is:

1. A foot hygiene device comprising:

a foundation member having an upper planar surface and a substantially parallel, spatially disposed lower planar surface, said foundation member further characterized as having a first portion, a second portion and a medial portion disposed therebetween;

ventral brush means supported by the upper planar surface of the foundation member for applying a scrubbing force to the ventral surface of a foot upon movement of the foot thereagainst, said ventral brush means comprising a substantially rectangularly shaped tufted brush member formed of a plurality of spatially disposed tufts extending upwardly from the medial portion of the foundation member, said tufted brush member characterized as having a first end portion and a second end portion;

lateral brush means supported by the upper planar surface of the foundation member for applying a scrubbing force to at least one lateral surface of the foot upon movement of the foot thereagainst, said lateral brush means extending upwardly from the foundation member so as to be substantially normally disposed to the upper planer surface of the foundation member, said lateral brush means comprising a first upright member supported by the foundation member substantially adjacent one side of the substantially rectangularly shaped tufted brush member of the ventral brush means;

a second upright member supported by the foundation member substantially adjacent a second side of the substantially rectangularly shaped tufted brush member of the ventral brush means so as to be substantially parallel to the first upright member;

a plurality of mutually spaced first side filament tufts extending integrally from the first upright member in the direction of the second upright member and substantially normally disposed to the filament tufts of the tufted brush member of the ventral brush means; and, a plurality of mutually spaced second side filament tufts extending integrally from the second upright member so as to be in a facing relationship with the first side filament tufts and substantially normally disposed to the filament tufts of the tufted brush member of the ventral brush means;

dorsal brush means for applying a scrubbing force to a dorsal surface of the foot upon movement of the foot thereagainst, the dorsal brush means supported by distal end portions of the first and second upright members of the lateral brush means a selected distance from the rectangularly shaped tufted brush member of the ventral brush means so that a substantially unrestricted passageway is formed therebetween, said dorsal brush means comprising:

a bridge member having a first end, a medial portion and a second end, the first end supported by the first upright member and the second end supported by the second upright member so that the medial portion forms an arch over the second end portion of the tufted brush member; and, a plurality of mutually spaced bridge filament tufts extending integrally from the medial bridge member in the direction of the tufted brush member; and, digital brush means for cleaning areas between digits of the foot as the dorsal surface of the foot is contacted with the dorsal brush means, the digital brush means supported by the brige member of the dorsal brush means and extending a selected distance into the passageway formed between the bridge member of the dorsal brush means and the tufted brush member of the ventral brush means such that upon movement of the ventral surface of the foot along the tufted brush member of the ventral brush means the digits of the foot are substantially free of contact with the digital brush means, said digital brush means comprising:

a plurality of spaced digital filament tufts extending integrally from the bridge member of the dorsal brush means in the direction of the tufted brush member of the ventral brush means, the digital filament tufts having a length greater than the length of the bridge filament tufts such that upon applying a scrubbing force to the dorsal surface of the foot by movmeent of the dorsal surface of the foot against the bridge filament tufts aligned digital filaments are moved between the digits of the foot.

2. The foot hygiene device of claim 1 wherein the tufted brush member and the foundation member are provided with an aperture extending therethrough, the aperture adapted to receive a hook element for hanging the device when not in use to enable the device to drain and dry.

3. The foot hygiene device of claim 1 wherein each of the digital filament tufts comprises a plurality of synthetic filaments extending from a prefused homogeneous mass of said filament material, and each of said prefused masses is received in one of selected apertures in the bridge member and conforms to the geometric confines of said aperture to hold said digital filament tufts to the bridge member.

4. The foot hygiene device of claim 3 further comprising stabilizing means secured to the lower planer surface of the foundation member for releasably securing the foundation member in position on a supporting surface.

5. The foot hygiene device of claim 3 wherein the stabilzing means comprises a rubberized member substantially conforming to the geometric configuration of the foundation member, said rubberized member having an aperture therein which is aligned with the aperture in the foundation member.

6. The foot hygiene device of claim 3 wherein the upper planar surface of the foundation member is constructed as an anti-skid surface.

7. A foot hygiene device comprising:

a base plate having a first portion, a medial portion and a second portion, the first and second portions being of sufficient dimension to enable a person's foot to be placed thereon;

stabilizing means secured to a lower surface of the base plate for releasably securing the base plate on a suporting surface; and, a brush assembly supported by the medial portion of the base plate, said brush assembly having a foot receiving passageway formed therein such that upon positioning one foot in the foot receiving passageway while securing the base plate by placement of the other foot on one of the first and second portions of the base plate and thereafter moving the one foot in a to and fro direction within the foot receiving passageway, said brush assembly selectively contacting at least one of the ventral surfaces, at least one of the lateral surfaces, and the dorsal surface of the one foot in a scrubbing action to clean said selected surface of the one foot, said brush assembly comprising:

a ventral brush supported by the medial portion of the base plate, said ventral brush having a plurality of upstanding filament tufts for applying a scrubbing force to the ventral surface of the one foot upon movement of the foot thereagainst, the filament tufts forming a distal end portion of the ventral brush having a length greater than the remaining filament tufts of the ventral brush so as to engage and clean an area of the foot between the ventral surface and the digits of the foot;

a pair of spatially disposed lateral brushes supported by the base plate so that one of the lateral brushes is disposed substantially adjacent one side of the ventral brush and the other of the lateral brushes is disposed substantially ajdacent an opposite side of the ventral brush, each of the lateral brushes extending upwardly from the base plate and having a plurality of lateral filament tufts disposed in a facing relationship and substantially normally disposed to the upstanding filament tufts of the ventral brush, the lateral filament tufts applying a scrubbing force to at least one of the lateral surfaces of the one foot upon movement of the foot thereagainst;

a dorsal brush supported by a distal end portion of the lateral brushes so as to be positioned a selected distance from the vertical brush and defines a foot receiving passageway therebetween, said dorsal brush having a plurality of downwardly extending dorsal filament tufts, the dorsal filament tufts applying a scrubbing force to a dorsal surface of the one foot upon movmement of the foot thereagainst; and, a plurality of digital brushes supported by the dorsal brush for cleaning areas between digits of the foot as the dorsal surface of the foot is contacted with the dorsal brush, the digital brushes supported by the dorsal brush so as to extend a selected distance into the foot receiving passageway such that upon movement of the ventral surface of the one foot along the ventral brush the digits of the foot are substantially free of contact with the digital brushes.

8. A foot hygiene device comprising:

a base plate having a first portion, a medial portion and a second portion, the first and second portions being of sufficient dimension to enable a person's foot to be placed thereon; and, a brush assembly supported by the medial portion of the base plate, said brush assembly having a foot receiving passageway formed therein such that upon positioning one foot in the foot receiving passageway while securing the base plate by placement of the other foot on one of the first and second portions of the base plate and thereafter moving the one foot in a to and fro direction within the foot receiving passageway, said brush assembly selectively contacts at least one of the ventral surfaces, at least one of the lateral surfaces, and the dorsal surface of the one foot in a scrubbing action to clean said selected surfaces of the one foot, said brush assembly comprising:

a ventral brush supported by the medial portion of the base plate, said ventral brush having a plurality of upstanding filament tufts for applying a scrubbing force to the ventral surface of one foot upon movement of the foot thereagainst;

a pair of spatially disposed lateral brushes supported by the base plate so that one of the lateral brushes is disposed substantially adjacent one side of the ventral brush and the other of the lateral brushes is disposed substantially adjacent an opposite side of the ventral brush, each of the lateral brushes extending upwardly from the base plate and having a plurality of lateral filament tufts disposed in a facing relationship and substantially normally disposed to the upstanding filament tufts of the ventral brush, the lateral filament tufts applying a scrubbing force to at least one of the lateral surfaces of the one foot upon movement of the foot thereagainst; and, a dorsal brush supported by a distal end portion of the lateral brushes so as to be positioned a selected distance from the vertical brush and forms a foot receiving passageway therebetween, said dorsal brush having a plurality of downwardly extending dorsal filament tufts for applying a scrubbing force to a dorsal surface of the one foot upon movement of the foot thereagainst, said dorsal brush comprising:

a bridge member having a first end, a medial portion and a second end, the first end supported by one of the lateral brushes and the second end supported by the other of the lateral brushes so that the medial portion forms an arch over one end portion of the ventral brush, the medial portion of the bridge member having a plurality of mutually spaced apertures formed on a lower side; and, a plurality of dorsal filament tufts formed of a plurality of synthetic filaments extending from a prefused homogeneous mass of filament material, each of said prefused masses received in one of the apertures in the bridge member and conforming to the geometric confines of said aperture such that the resulting dorsal filament tufts are secured to the bridge member; and, a plurality of digital brushes supported by the medial portion of the bridge member so as to be spatially disposed, the digital brushes being formed of a plurality of spaced digital filament tufts extending integrally from the medial portion of the bridge member in the direction of the ventral brush, the digital filament tufts having a length greater than the dorsal filament tufts such that upon applying a scrubbing force to the dorsal surface of the foot, by movement of the dorsal surface of the foot against the dorsal filament tufts, the digital filament tufts are moved between the digits of the foot.

9. The foot hygiene device of claim 8 wherein each of the digital filament tufts comprises a plurality of synthetic filaments extending from a prefused homogeneous mass of said material, each of said prefused masses received in one of selected apertures in the brige member and conforming to the geometric confines of said aperture to hold said digital filament tufts to the bridge member.

10. A foot hygiene device comprising:

a base plate having a first portion, a medial portion and a second portion, the first and second portions being of sufficient dimension to enable a person's foot to be placed thereon;

stabilizing means secured to a lower surface of the base plate for releaseably securing the base plate on a supporting surface; and, a brush assembly supported by the medial portion of the base plate, said brush assembly having a foot receiving passageway formed therein such that upon positioning one foot in the foot receiving passageway, while securing the base plate by placement of the other foot on one of the first and second portions of the base plate, and thereafter moving the one foot in a to and fro direction within the foot receiving passageway said brush assembly selectively contacts at least one of the ventral surfaces one of the lateral surfaces, and the dorsal surface of the foot disposed within the foot receiving passageway in a scrubbing action to clean said selected surfaces of the foot, said brush assembly comprising:

a ventral brush supported by the medial portion of the base plate, said ventral brush having a plurality of upstanding filament tufts for applying a scrubbing force to the ventral surface of the foot upon movement of the foot in a to and fro direction within the foot receiving passageway so that the ventral portion of the foot scrubbingly contacts the ventral brush;

a pair of spatially disposed lateral brushes supported by the base plate so that one of the lateral brushes is disposed substantially adjacent one side of the ventral brush and the other of the lateral brushes is disposed substantially ajdacent an opposite side of the ventral brush, each of the lateral brushes extending upwardly from the base plate and having a plurality of lateral filament tufts disposed in a facing relationship and substantially normally disposed to the upstanding filament tufts of the ventral brush, the lateral filament tufts applying a scrubbing force to at least one of the lateral surfaces of the foot upon movement of the foot in the to and fro direction within the foot receiving passageway such that at least one of the lateral surfaces of the foot scrubbingly contacts the adjacently disposed lateral brush; and, a dorsal brush supported by a distal end portion of the lateral brushes so as to be positioned a selected distance from the ventral brush and defines the foot receiving passageway, said dorsal brush having a plurality of downwardly extending dorsal filament tufts, the dorsal filament tufts applying a scrubbing force to a dorsal surface of the foot upon movement of the foot in the to and fro direction within the foot receiving passageway such that the dorsal surface of the foot contacts the dorsal filament tufts of the dorsal brush, said dorsal brush comprising:

a bridge member having a first end, a medial portion and a second end, the first end supported by one of the lateral brushes and the second end supported by the other of the lateral brushes so that the medial portion forms an arch over one end portion of the ventral brush, the medial portion of the bridge member having a plurality of mutually spaced apertures formed on a lower side; and, a plurality of synthetic filaments extending from a prefused homogeneous mass of filament mateial, each of said prefused masses received in one of the apertures in the bridge member and conforming to the geometric confines of said apertures to hold said dorsal filament tufts to the bridge member; and digital brush means supported by the bridge member for cleaning the digits of the foot as the foot is moved in a to and fro direction, the digital brush means extending downwardly and having a length greater than the dorsal filament tufts of the bridge member.

* * * * *